United States Patent [19]

Davis

[11] 4,256,032

[45] Mar. 17, 1981

[54] IMPROVED STRAP GUIDE SYSTEM

[75] Inventor: James P. Davis, Crawfordsville, Ind.

[73] Assignee: Keystone Consolidated Industries, Inc., Peoria, Ill.

[21] Appl. No.: 91,546

[22] Filed: Nov. 5, 1979

[51] Int. Cl.[3] ..... B65B 13/04

[52] U.S. Cl. ..... 100/26; 100/3

[58] Field of Search ..... 100/3, 25, 26, 7

[56] References Cited

U.S. PATENT DOCUMENTS

| | | | |
|---|---|---|---|
| 2,416,859 | 3/1947 | Vining | 100/3 |
| 2,632,381 | 3/1953 | Buckland | 100/3 |
| 2,732,792 | 1/1956 | White | 100/3 |
| 2,831,422 | 4/1958 | Black et al. | 100/3 |
| 2,959,118 | 11/1960 | Hager | 100/26 |

*Primary Examiner*—Billy J. Wilhite

*Attorney, Agent, or Firm*—Allegretti, Newitt, Witcoff & McAndrews

[57] ABSTRACT

An improved strap guide for a package strapping system having an upper movable horizontal strap guide section, integral with or connected to a compression bar having press feet extending on each side of the movable strap guide section toward a package to be strapped and means for moving the upper strap guide and compression bar toward and away from the package to be strapped.

5 Claims, 5 Drawing Figures

IMPROVED STRAP GUIDE SYSTEM

BACKGROUND OF THE INVENTION

The present invention is related to an improved system for compressing and strapping a compressible package, such as a bundle of newspapers, magazines, or other material.

It has been found that the location of the strap on a compressible package or bundle may be quite critical. For example, where the strap is located close to the end of a bundle or package, the strap as it is tightened around the package occasionally moves to one side or the other and may even miss the package entirely.

It has also been found that the application of compressive force on the compressible package or bundle should be ideally located close along both sides of the strap. In the past, two independent press assemblies, one on each side of the strap line, were used. However, this in turn created additional problems, including expense in manufacture and assembly and complication and multiplication of moving parts.

Accordingly, it is desirable to provide a new, improved, simpler, and more economic system for guiding the strap about a package in a package strapping system and for compressing a compressible package or bundle in that machine. It is an object of the present invention to provide such a structure with improved and simplified means for compressing the package and for guiding the strap thereabout.

It is yet a further object of the present invention to provide such a system which will accurately and precisely locate the strap in relation to the compression members and in relation to the application of compression force. These and other objects, advantages, and features of the present invention will be better understood by reference to the detailed description of the preferred embodiment.

SUMMARY OF THE INVENTION

The present invention is an improvement for a package strapping system of the type adapted to encircle a compressible package with a strap, tighten the strap about the package, and seal the tightened strap. The improvement is directed to a strap guide having a movable guide section adapted to releasably retain a run of strap, a movable package compression bar connected to the movable guide section of the strap guide and extending longitudinally along the guide section and means for moving the movable guide section and the connected compression bar toward and away from the package to be strapped so that the package may be compressed by the compression bar uniformly along both sides of the strap and so that precise placement of the strap on the package in relation to the package compression is provided.

BRIEF DESCRIPTION OF THE DRAWINGS

There follows a brief description of the drawings, showing a presently preferred embodiment of the present invention, wherein like numerals refer to like elements and wherein.

DETAILED DESCRIPTION OF THE PREFERRED EMBODIMENT

Figure 1:
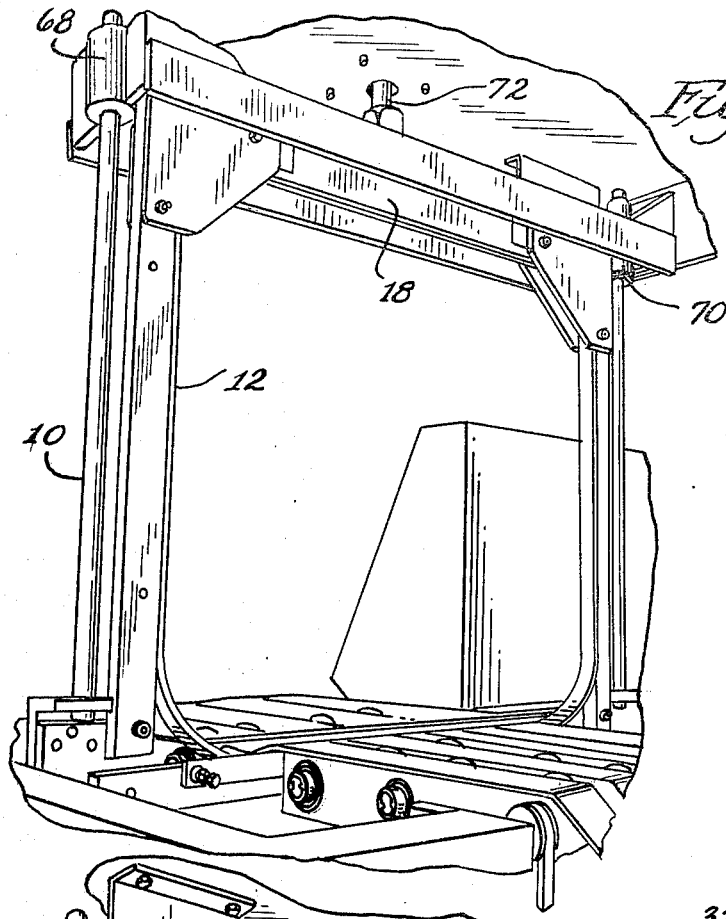
FIG. 1 is a perspective view of the present invention, showing the compression bar and movable strap guide section in its uppermost position.
Figure 3:
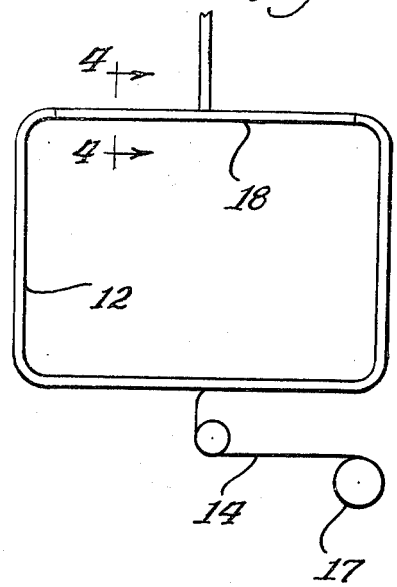
FIG. 3 is a diagramatic side view of the strap guide of the package strapping system.

Referring now to FIG. 1, a package strapping machine 10 is briefly shown. Details of the system which are not essential to an understanding of this invention have not been included. However, a more detailed discussion of package strapping systems of the type developed by the assignee of this application are shown in greater detail in the co-pending application, Ser. No. 34,610, filed Apr. 30, 1979, now abandoned, by James P. Davis and Robert W. Smith.

Figure 2:
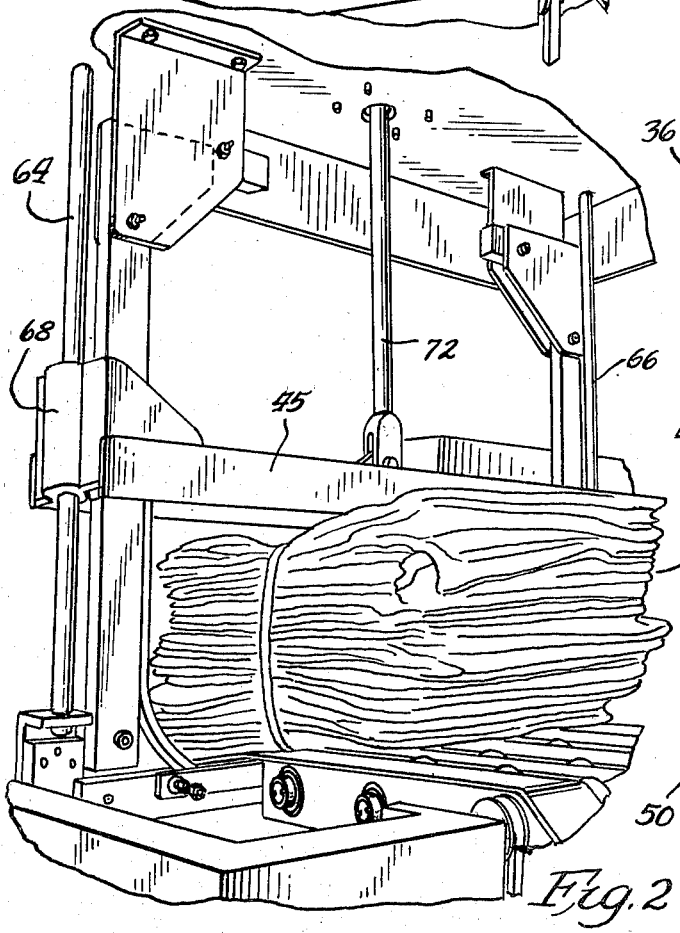
FIG. 2 is a perspective view of the present invention, showing the compression bar and movable strap guide section advanced into compression against the bundle to be strapped.

Strap 14 is fed from a supply 17 to the package strapping machine 10 and through a ring guide 12 so as to encircle a package 16 as shown in FIG. 2.

The strap ring guide 12 includes a movable upper guide ring section 18 which, in the preferred embodiment, is a linear run extending from the upper left curved portion to the upper right curved portion of the ring 12. This movable guide section 18 is shown in greater detail in the cross-sectional view of FIG. 4. It may, in the preferred embodiment, include a rectangularly shaped bar 20 and a pair of spring biased doors 22 and 24.

Each of the doors 22 and 24 may be formed of metal plate, having two sections defining substantially a right angle. Door 22 includes holes one being shown at 26. Door 24 includes holes 28 and 29 complimentary to holes 26 and 27. Additional holes, one being shown at 30 are defined in bar 20 to be complimentary with holes in doors 22 and 24. These holes are adapted to receive a pair of bolts, only one of which (32) is shown.

Figure 4:
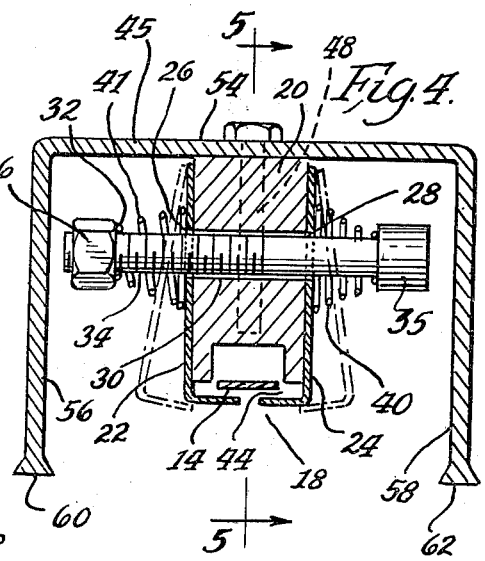
FIG. 4 is a cross-section of the compression bar and movable strap guide section, taken along the line 4—4 of FIG. 2.
Figure 5:
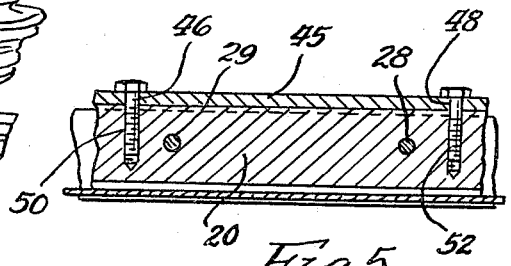
FIG. 5 is a cross-section of the compression bar and movable strap guide section, taken along the line 5—5 of FIG. 4.

Bolt 32 includes a neck portion 34, head portion 35, and nut 36. A spring 40 is mounted between head portion 35 on the neck portion 34. A second spring 41 is mounted on the neck portion 34 and biased against the nut 36. An additional bolt (not shown) is provided with springs, head portion, and nut substantially as shown with respect to bolt 32. These springs serve to bias the doors 22 and 24 against adjacent sides of the bar 20 so as to maintain the doors closed as shown in FIG. 4.

The doors 22 and 24 are configured to extend somewhat below the lower surface of the bar 20 so as to provide a guide channel 44 for the strap 14. When the strap is fed through the ring guide 12, including the movable upper guide ring section 18, it travels in the channel 44 defined between the lower portion of doors 22 and 24 and the adjacent lower surface of the bar 20 as shown in FIG. 4. When the strap is tightened about the package 14, the increased tension in the strap draws the strap downward causing the doors 22 and 24 to move outwardly against the spring biasing force, allowing the strap 14 to be pulled down about the package 16.

The bar 20 is fastened to a movable package compression bar 45 by means of screws 46 and 48 passing from the compression bar 45 and through threaded holes 50 and 52 in the bar 20. The movable compression bar 45 is substantially U-shaped in cross-section, having a main section 54 and a pair of legs 56 and 58 extending at right angles from the main section 54. Press feet 60 and 62 extend along the length of the movable compression bar 45, integral with legs 56 and 58 respectively.

The compression bar 45 and the connected movable upper guide ring section 18 are mounted for linear, vertical movement toward and away from a package 16. To effectuate this mounting for vertical movement, cylindrical metal slides 64 and 66 are vertically positioned on opposite sides of the movable compression bar 45. First and second collars 68 and 70 are rigidly connected to opposite ends of the movable compression bar 45. Collars 68 and 70 include cylindrically-shaped channels defined therein having diameters slightly greater than that of the cyfrom the package 16.

A means for moving the movable guide section 18 and connected compression bar 45 is also provided. This means, in a preferred embodiment, is a pneumatically-actuated piston rod 72 connected to the main section 54 of the compression bar 45 as shown in FIG. 2. When the piston rod is operated by means (not shown), it is extended or retracted causing the compression 45 to lower or raise in a vertical plane constrained by the mounting of the collars 68 and 70 on the slides 64 and 66.

When the compression bar 45 is moved downwardly against the package 16, the package 16 is compressed on opposite sides of the strap 14, and the strap 14 is precisely positioned around the package 16 in relation to the applied compression. The press feet 60 and 62 of the compression bar 45 extend beyond the edge of the package 16 so as to uniformly compress the package 16 along both sides of the strap 14. Precise placement of the strap 14 on the package 16 in relation to the package compression is, thus, provided.

While in the forgoing there has been described a presently preferred embodiment of the present invetion, it is to be understood that this embodiment is merely illustrative of the true spirit and scope of the invention.

What is claimed is:

1. In a package strapping system of the type adapted to encircle a compressible package with a strap, tighten the strap about the package and seal the tightened strap, an improved strap guide and package compression system comprising, in combination:

a strap guide ring having a movable guide section adapted to releasably retain a run of strap, a movable package compression bar connected to the movable guide section of the strap guide ring and extending longitudinally along the movable guide section, the compression bar having first and second press feet extending longitudinally along the movable guide section on opposite sides thereof and extending beyond the sides of the movable guide section, and means for moving the movable guide section and connected compression bar toward and away from the package to be strapped whereby the package may be compressed by the press feet uniformly along both sides of the strap contained in the upper guide section and whereby precise placement of the strap on the package in relation to package compression is provided.

2. The improvement is set forth in claim 1 wherein the movable guide section of the strap guide includes a channel defined by an inner elongated member having a strap guide surface and by door means adjacent the elongated member, the door means having a strap release opening adjacent the strap guide surface of the elongated member and means for flexibly biasing the door means closed whereby when the strap is tightened about the package, the strap tension force may cause the biased doors to open, thereby releasing the strap from the movable guide section.

3. The improvement as set forth in claim 1 wherein the movable compression bar comprises a single section of sheet metal having an intermediate side and two outer sides with each side being substantially transverse to its adjacent side and wherein the sheet metal section is rigidly connected at the inner surface of the intermediate side thereof to the movable strap guide section.

4. The combination as set forth in claim 3 wherein the outer edge portions of each outer side of the sheet metal section are provided with widened package contact portions which form the press feet for compressing the package.

5. The improvement as set forth in claim 1 including means for mounting the compression bar for linear reciprocal movement toward and away from a package platform whereby the compression bar and connected guide section may be uniformly moved into a strap guide position in preparation for strap feeding or into a package compression position for package strapping.

* * * * *